US006902035B2

(12) United States Patent
Baumgartner et al.

(10) Patent No.: US 6,902,035 B2
(45) Date of Patent: Jun. 7, 2005

(54) STEP STOOL WITH STEP LOCK

(75) Inventors: Joseph Baumgartner, Carmel, IN (US); Andrew Mendenhall, Indianapolis, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/636,395

(22) Filed: Aug. 7, 2003

(65) Prior Publication Data

US 2005/0029050 A1 Feb. 10, 2005

(51) Int. Cl.[7] ..... E06C 1/00
(52) U.S. Cl. ..... 182/165
(58) Field of Search ..... 182/161, 165, 182/46, 180.1, 129, 162, 163, 22–26; D25/64, D25/65

(56) References Cited

U.S. PATENT DOCUMENTS

| | | | | |
|---|---|---|---|---|
| 4,440,264 | A | 4/1984 | Knoke et al. | |
| 4,485,892 | A | 12/1984 | Maloney et al. | |
| 4,793,163 | A | 12/1988 | MacFarlane et al. | |
| 5,722,507 | A | 3/1998 | Kain | |
| 5,762,163 | A | 6/1998 | Kain | |
| 5,992,567 | A | 11/1999 | Chiu | |
| 6,026,933 | A | 2/2000 | King et al. | |
| 6,390,237 | B1 | 5/2002 | Kim et al. | |
| 6,390,238 | B1 * | 5/2002 | Gibson et al. | 182/161 |
| 6,427,805 | B1 | 8/2002 | Gibson et al. | |
| 6,550,579 | B2 | 4/2003 | Gibson et al. | |

* cited by examiner

*Primary Examiner*—Hugh B. Thompson, II
(74) *Attorney, Agent, or Firm*—Barnes & Thornburg LLP

(57) ABSTRACT

A step stool includes a frame, a step coupled to the frame for pivotable movement, and a step lock. The step lock is used to lock the step to block pivotable movement of the step relative to the frame.

23 Claims, 5 Drawing Sheets

STEP STOOL WITH STEP LOCK

BACKGROUND

The present disclosure relates to step stools. More particularly, the present disclosure relates to step stools that have a step lock.

Step stools have a frame and one or more steps. The steps may be used by individuals for elevation when reaching for objects, painting walls, or any everyday task where extra elevation would be helpful.

SUMMARY

According to the present disclosure, a step stool includes a frame and a step coupled to the frame for pivotable movement. A step lock is used to block pivotable movement of the step relative to the frame.

In an embodiment of the step stool, the frame is foldable between folded and unfolded positions. The step lock includes a latch able to pivot between a latch position and a release position. In the latch position, the latch is arranged to latch to a strut of the frame to block pivotable movement of the step to maintain the frame in its unfolded position. In the release position, the latch is arranged to release the strut to allow pivotable movement of the step so that the step stool can be folded.

The step includes a platform to support a person thereon. A notch member is included in a periphery of the platform and formed to include a notch. The latch is arranged for pivotable movement in the notch. A pivot limiter is mounted to the notch member and arranged to engage the latch when the latch assumes the release position to limit pivotable movement of the latch in the notch away from the latch position. Limiting pivotable movement of the latch facilitates pivotable movement of the step and, in turn, facilitates folding of the frame.

Additional features of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION

Figure 1:
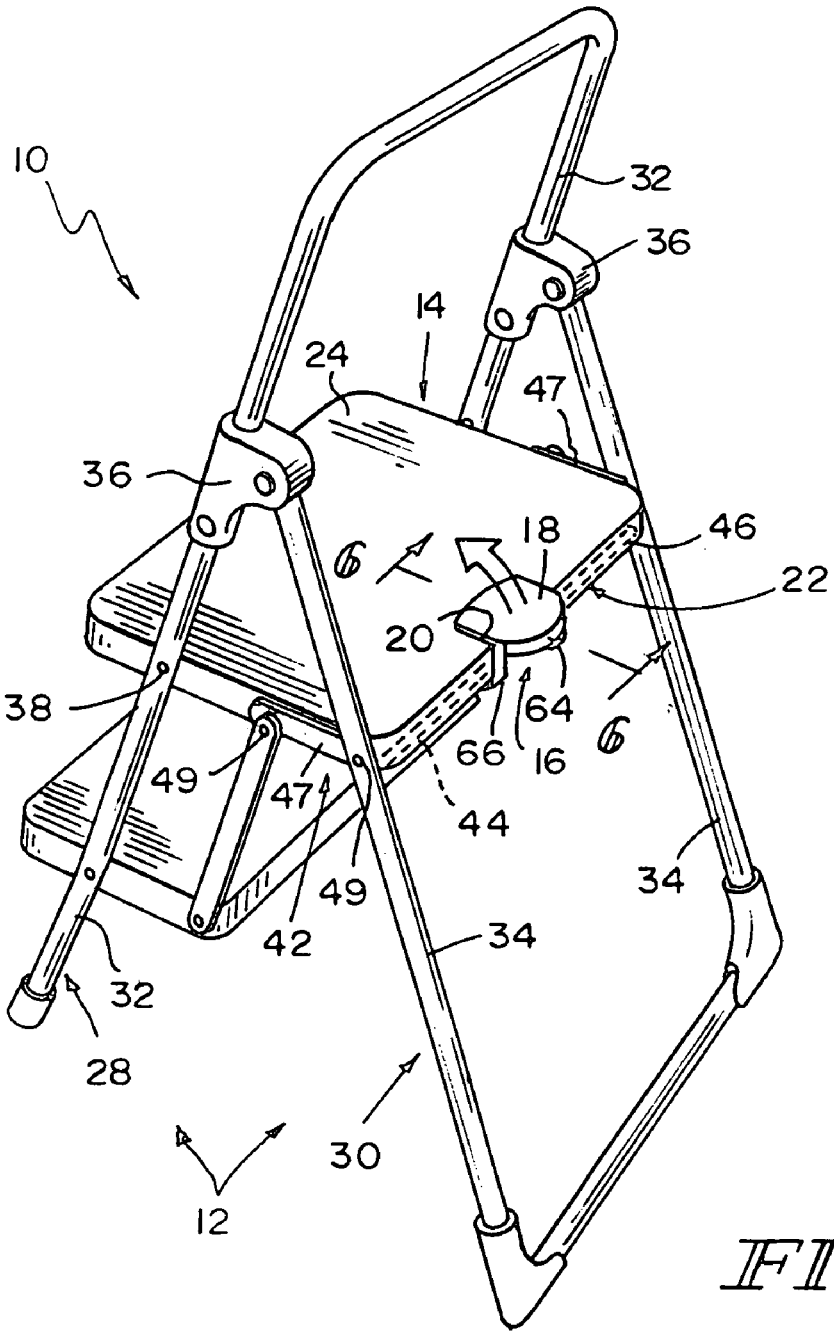
FIG. 1 is a perspective view of a step stool showing the step stool including a foldable frame, a pivotable step mounted to the frame, and a step lock including a latch arranged in a latch position in a notch formed in a periphery of a platform of the step to lock the step in place to maintain the frame in an unfolded position.
Figure 2:
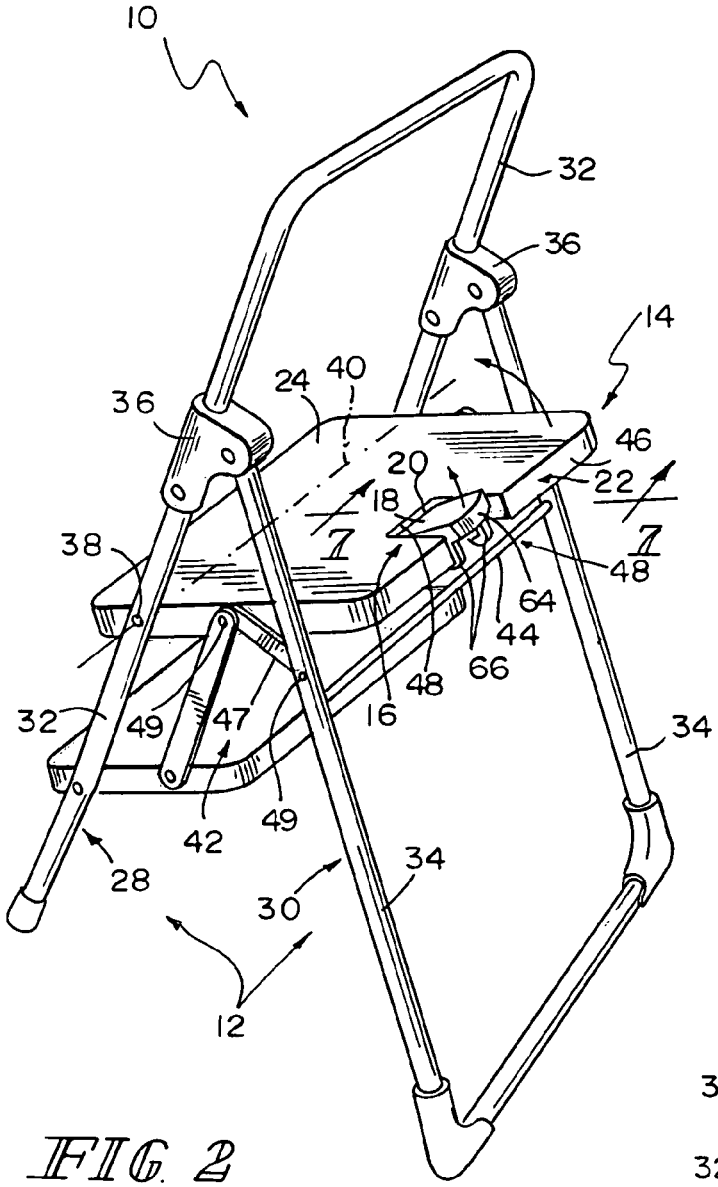
FIG. 2 is a perspective view showing the latch pivoted to a release position for engagement with a pivot limiter shown in FIGS. 4, 6, and 7 to facilitate pivotable movement of the step to fold the frame.
Figure 3:
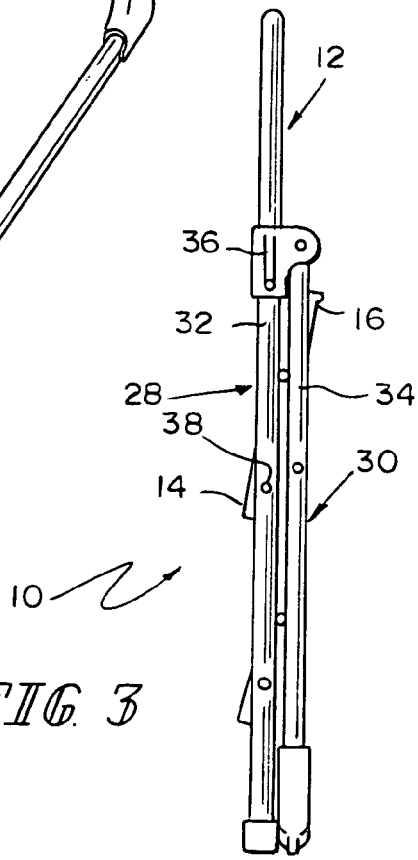
FIG. 3 is a side elevation view showing the step stool folded.

A step stool 10 shown in FIGS. 1–3 includes a foldable frame 12, a step 14 mounted to frame 12 for pivotable movement, and a step lock 16. Frame 12 is arranged to move between an unfolded position shown in FIG. 1 and a folded position shown in FIG. 3. Step lock 16 includes a latch 18 mounted for pivotable movement in a notch 20 formed in a periphery 22 of a platform 24 included in step 14 between a latch position shown in FIGS. 1 and 6 and a release position shown in FIGS. 2 and 7. In the latch position, latch 18 is arranged to latch to frame 12 to block pivotable movement of step 14 to maintain frame 12 in its unfolded position. In the release position, latch 18 is arranged to release frame 12 to allow pivotable movement of step 14 to move frame 12 to its folded position.

Figure 4:
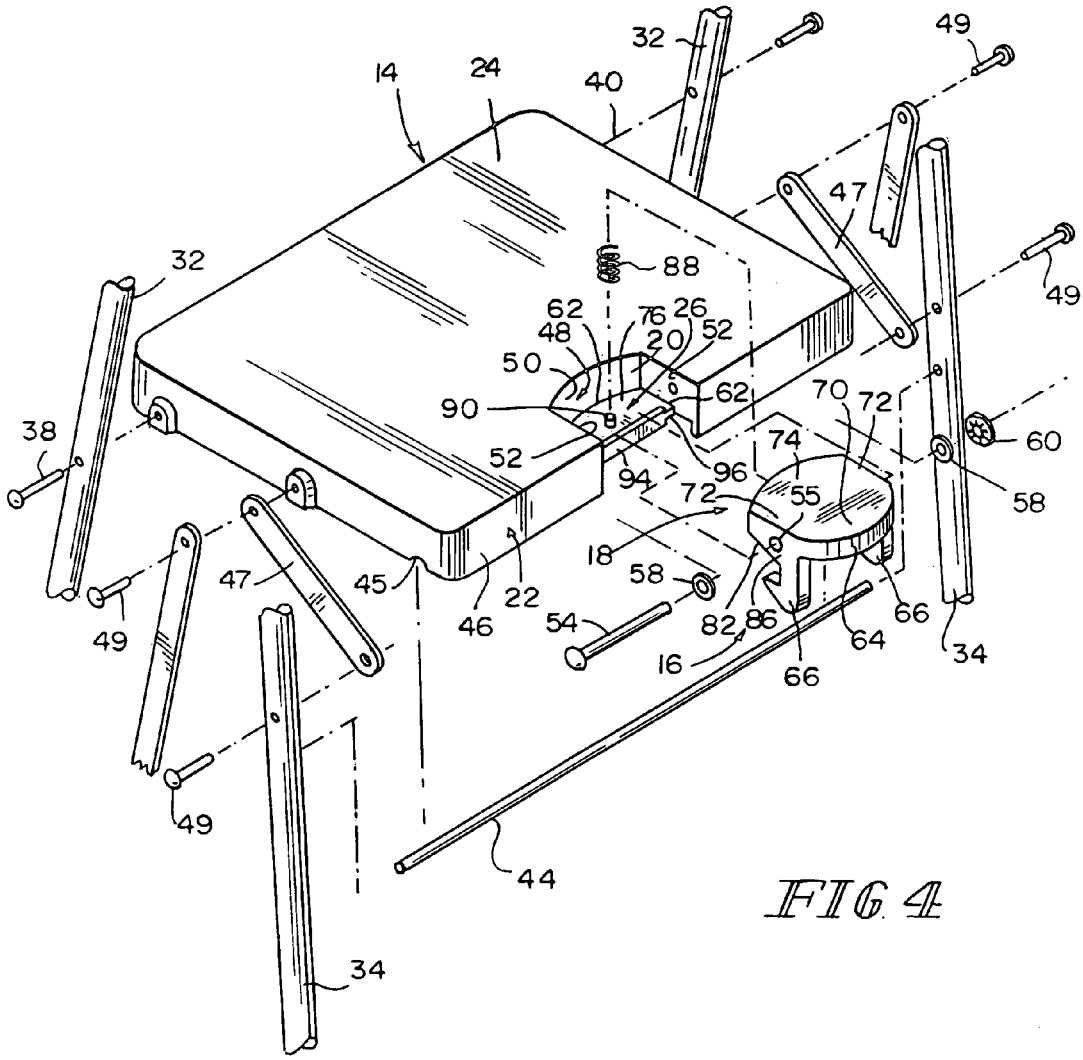
FIG. 4 is an exploded perspective view showing the pivot limiter arranged, for example, as a plate mounted to a notch member formed to include the notch in the periphery of the platform.
Figure 6:
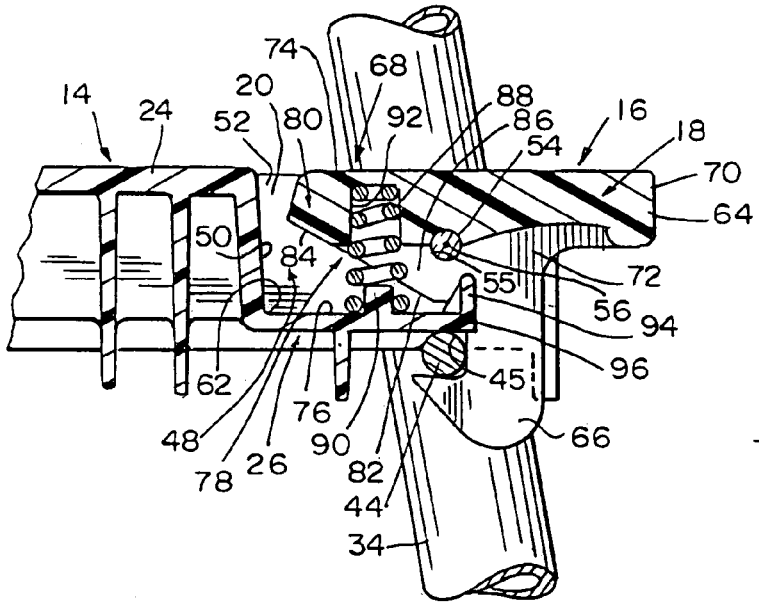
FIG. 6 is a sectional view taken along lines 6—6 of FIG. 1 showing the latch positioned in its latch position by a latch pivoter in the form of, for example, a spring mounted between the pivot limiter and the latch.
Figure 7:
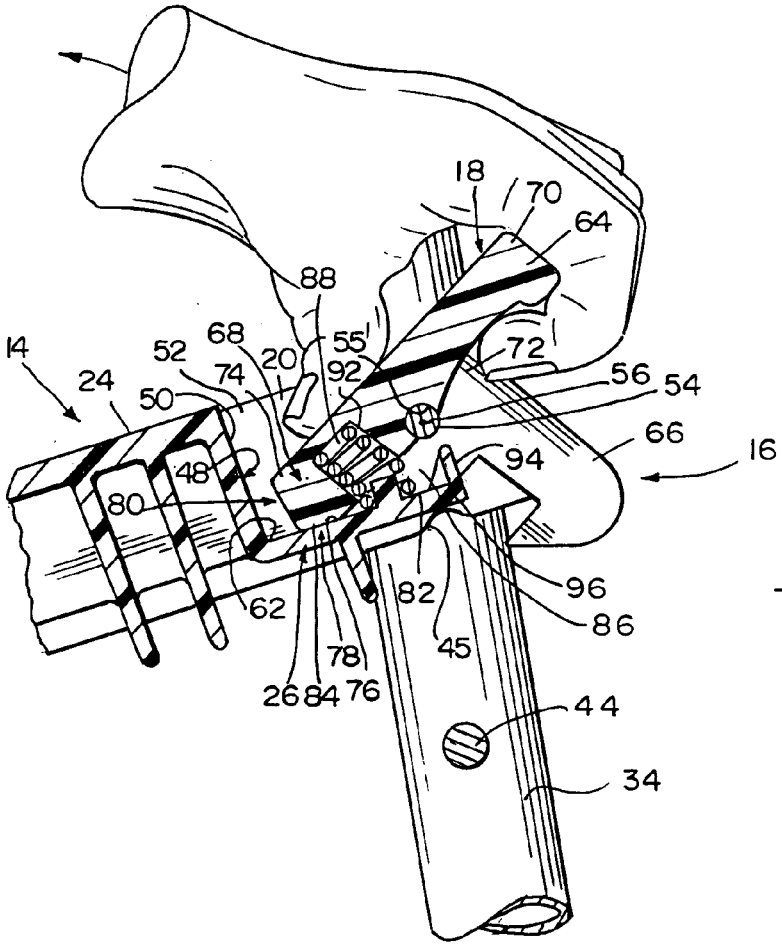
FIG. 7 is a sectional view taken along lines 7—7 of FIG. 2 showing engagement between the limiter engagement surface of the latch and a latch engagement surface of the pivot limiter to facilitate pivotable movement of the step and folding of the frame.

Step 14 includes a pivot limiter 26 shown in FIGS. 4, 6, and 7. Pivot limiter 26 is arranged to engage latch 18 when latch 18 assumes the release position to limit pivotable movement of latch 18 in notch 20 away from the latch position to facilitate pivotable movement of step 14 relative to frame 12 to move frame 12 from the unfolded position to the folded position upon application of a folding force to latch 18. Pivot limiter 26 thus provides pivot limiter means for engaging latch 18 when latch 18 assumes the release position to limit pivotable movement of latch 18 in notch 20 away from the latch position to facilitate pivotable movement of step 14 relative to frame 12 to move frame 12 from the unfolded position to the folded position upon application of a folding force to latch 18.

Frame 12 includes a front leg unit 28 and a rear leg unit 30, as shown in FIGS. 1–3. Front and rear leg units 28, 30 are coupled to one another for pivotable movement between the folded and unfolded positions. Front leg unit 28 includes a pair of legs 32 and rear leg unit 30 includes a pair legs 34. Legs 32 and legs 34 coupled to one another by leg pivots 36 for pivotable movement of front and rear leg units 28, 30.

Platform 24 of step 14 is mounted to front leg unit 28 for pivotable movement relative thereto, as shown in FIGS. 1, 2, and 4. Platform pivots 38 shown in FIG. 4 are mounted to front legs 32 and establish a platform pivot axis 40 about which the platform 24 pivots upon movement of the front and rear leg units 28, 30 between the folded and unfolded positions.

A platform pivoter 42 interconnects platform 24 and rear leg unit 30, as shown in FIGS. 1, 2, and 4. Platform pivoter 42 is arranged to pivot platform 24 relative to front leg unit 28 upon movement of units 28, 30 between the folded and unfolded positions. During movement of units 28, 30 from the folded position to the unfolded position, platform pivoter 42 pivots platform 24 so that notch members 45 included in opposite sides of platform 24 come to rest on a strut 44 mounted to rear legs 34 therebetween. In the illustrated embodiment, platform pivoter 42 includes a pair of links 47 and a pair of pivot mounts 49 for each link 47.

Periphery 22 of platform 24 is formed to include notch 20, as shown best in FIG. 4. A rear portion 46 of periphery 22 includes a notch member 48. Notch member 48 is formed to include notch 20. Notch member 48 includes an inner wall 50 and a pair of spaced-apart side walls 52 extending outwardly from inner wall 50.

Pivot limiter 26 is mounted to notch member 48, as shown in FIGS. 4, 6, and 7. In the illustrated embodiment, pivot limiter 26 is a plate (which may be referred to as a pivot limiter plate) mounted to a bottom edge 62 of notch member 48 and mounted to inner wall 50 and side walls 52 so as to extend across notch 20. It is within the scope of this disclosure for pivot limiter 26 to have other configurations. For example, pivot limiter 26 may be arranged as some other body (e.g., posts, blocks, walls) mounted to platform 24 in some other location (e.g., above bottom edge 62 on notch member 48, below bottom edge 62 to underside of platform 24).

Step lock 16 includes a latch pivot axle 54 that extends through axle-receiving apertures 55 formed in latch 18, as shown in FIG. 4. Latch pivot axle 54 is mounted to notch member side walls 52 and supports latch 18 for pivotable movement about a latch pivot axis 56 shown in FIGS. 6 and 7 between the latch and release positions. Washers 58 and an axle retainer 60 shown in FIG. 4 are used with axle 54 in mounting axle 54 to side walls 52. It is within the scope of this disclosure to mount latch 18 for pivotable movement in a variety of other ways.

Latch 18 includes a handle 64, a pair of couplers 66, and a limiter engager 68, as shown in FIGS. 4–7. Handle 64 is located along a latch outer portion 70 and is arranged to be gripped by the hand of a person to pivot latch 18 from the latch position to the release position as suggested in FIGS. 2 and 7. Each coupler 66 is located along a latch side portion 72 and is arranged to latch to strut 44 when frame 12 assumes the unfolded position and latch 18 assumes the latch position. Limiter engager 68 is located along latch side portions 72 and along a latch inner portion 74 in notch 20 and arranged to engage pivot limiter 26 when latch 18 assumes the release position.

Pivot limiter 26 and limiter engager 68 are arranged for engagement with one another. Pivot limiter 26 underlies limiter engager 68 and includes a latch engagement surface 76 shown in FIGS. 4, 6, and 7. Limiter engager 68 includes a limiter engagement surface 78 shown in FIGS. 5–7. Limiter engagement surface 78 is inclined relative to the latch engagement surface 76 when latch 18 is positioned in the latch position, as shown in FIG. 6, and mates against latch engagement surface 76 when latch 18 is positioned in the release position, as shown in FIG. 7. In the illustrated embodiment, surfaces 76, 78 are generally planar. It is within the scope of the disclosure for surfaces 76, 78 to be non-planar.

Figure 5:
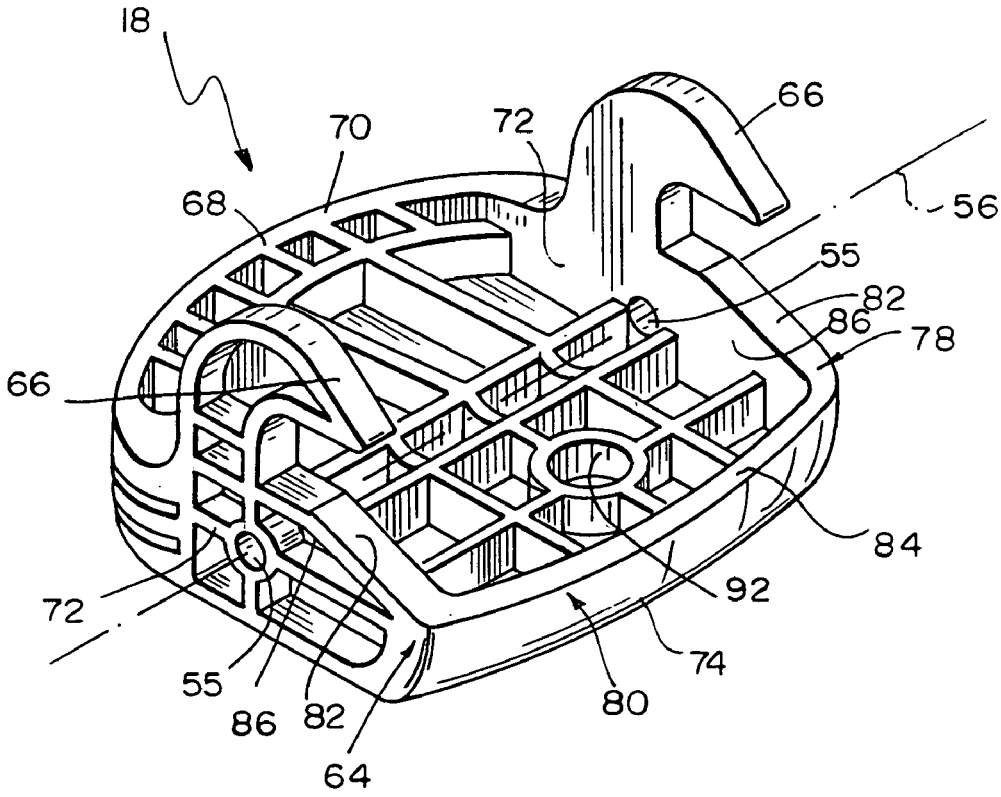
FIG. 5 is a perspective view showing the latch including an inclined, generally U-shaped limiter engagement surface (on the right) that is used to mate against the pivot limiter when the latch assumes the release position.

Limiter engagement surface 78 is formed on a lower rim 80 of latch 18, as suggested in FIG. 5. Side portions 82 of surface 78 extend along latch side portions 72 on rim 80 and an inner portion 84 of surface 78 extends along latch inner portion 74 on rim 80. Rim 80 includes a coupler support web 86 to support a coupler 66 and each side portion 82 is formed on one of coupler support webs. Side portions 82 and inner portion 84 are arranged such that limiter engagement surface 78 is generally C-shaped.

Step lock 16 includes a latch pivoter 88, as shown in FIGS. 4, 6, and 7. Latch pivoter 88 is arranged to pivot latch 18 from the release position to the latch position.

In the illustrated embodiment, latch pivoter 88 is a coil spring mounted to pivot limiter 26 and latch 18. A first pivoter retainer 90 mounted to pivot limiter is arranged to retain an end portion of spring 88 in place. First pivoter retainer 90 is, for example, a boss extending from latch engagement surface 76. An opposite end portion of spring 88 is retained by a second pivoter retainer 92. Second pivoter retainer 92 is, for example, a cylindrical recessed portion that is formed in latch 18 and receives the opposite end portion of spring 88. Rim 80 partially surrounds second pivoter retainer 92. It is within the scope of this disclosure for latch pivoter 88 to take other forms. For example, latch pivoter 88 may be a torsion spring and may be mounted in a different location such as next to one of latch side portions 72 within or outside of rim 80.

An access inhibitor 94 shown in FIGS. 4, 6, and 7 is arranged to inhibit access to pivot limiter 26. Access inhibitor 94 is positioned outwardly from pivot limiter 26 underneath latch 18. In the illustrated embodiment, access inhibitor 94 is a wall extending along and upwardly from an outer portion 96 of pivot limiter 26.

What is claimed is:

1. A step stool comprising a foldable frame arranged to move between folded and unfolded positions, a step mounted to the frame for pivotable movement relative thereto, the step including a platform that is arranged to support a person thereon and includes a periphery formed to include a notch, and a latch mounted for pivotable movement relative to the step in the notch between a latch position to latch to the frame to block pivotable movement of the step relative thereto and a release position to release the frame to allow pivotable movement of the step relative thereto, the step including pivot limiter means for engaging the latch when the latch assumes the release position to limit pivotable movement of the latch in the notch away from the latch position to facilitate pivotable movement of the step relative to the frame to move the frame from the unfolded position to the folded position upon application of a folding force to the latch.

2. The step stool of claim 1, wherein the latch includes a limiter engager, the notch is defined by a notch member included in the periphery, and the pivot limiter means includes a pivot limiter plate mounted to the notch member and positioned underneath the limiter engager for engagement therewith.

3. The step stool of claim 2, wherein the notch member includes a bottom edge and the pivot limiter plate is mounted to the bottom edge.

4. The step stool of claim 2, wherein the limiter engager includes a limiter engagement surface, the pivot limiter plate includes a latch engagement surface, the limiter engagement surface is inclined relative to the latch engagement surface when the latch is positioned in the latch position and mates against the latch engagement surface when the latch is positioned in the release position.

5. The step stool of claim 2, wherein the latch includes a handle and a coupler arranged to latch to a strut of the frame and the coupler is positioned between the handle and the limiter engager.

6. The step stool of claim 1, further comprising a spring, wherein the pivot limiter means includes a pivot limiter plate mounted to the platform for engagement with the latch and the spring is mounted to the pivot limiter plate to move the latch to the latch position.

7. A step stool comprising a frame, a step mounted to the frame for pivotable movement relative thereto, the step including a platform and a pivot limiter means, the platform being arranged to support a person thereon and including a periphery formed to include a notch, and a latch mounted for pivotable movement relative to the step in the notch between a latch position to latch to the frame to block pivotable movement of the step relative to the frame and a release position to allow pivotable movement of the step relative to the frame, the pivot limiter means for engaging the latch when the latch assumes the release position to limit pivotable movement of the latch in the notch away from the latch position.

8. The step stool of claim 7, wherein the latch includes a limiter engager and the pivot limiter means includes a pivot limiter plate arranged for engagement with the limiter engager.

9. The step stool of claim 8, wherein the notch is defined by a notch member formed in the periphery of the platform, the notch member includes a bottom edge, and the pivot limiter plate is mounted to the bottom edge.

10. The step stool of claim 8, wherein the notch is defined by a notch member formed in the periphery of the platform, the notch member includes an inner wall and a pair of spaced-apart side walls extending outwardly from the inner wall, and the pivot limiter plate is mounted to the inner wall and the side walls so as to extend across the notch.

11. The step stool of claim 8, further comprising a spring mounted to the pivot limiter plate to move the latch from the release position to the latch position.

12. The step stool of claim 11, wherein the step includes an access inhibitor mounted to the pivot limiter plate outwardly from the spring and underneath the latch to inhibit access to the spring.

13. A step stool comprising a frame, a step mounted to the frame for pivotable movement relative thereto, the step including a platform and a pivot limiter, the platform being arranged to support a person thereon and including a periphery formed to include a notch, and a latch mounted for pivotable movement relative to the step in the notch between a latch position to latch to the frame to block pivotable movement of the step relative to the frame and a release position to allow pivotable movement of the step relative to the frame, the pivot limiter being arranged to engage the latch when the latch assumes the release position to limit pivotable movement of the latch in the notch away from the latch position, wherein the latch includes a limiter engager and the pivot limiter includes a pivot limiter plate arranged for engagement with the limiter engager, and wherein the pivot limiter plate is positioned in the notch underneath the limiter engager.

14. The step stool of claim 13, wherein the limiter engager is arranged to engage the pivot limiter, a handle, and a coupler arranged to latch to the frame and positioned between the limiter engager and the handle.

15. The step stool of claim 13, wherein the latch includes a limiter engagement surface, the pivot limiter includes a latch engagement surface, the limiter engagement surface is inclined relative to the latch engagement surface when the latch is positioned in the latch position and mates against the latch engagement surface when the latch is positioned in the release position.

16. The step stool of claim 15, wherein the limiter engagement surface is generally C-shaped.

17. The step stool of claim 15, wherein the latch includes an inner latch portion positioned in the notch, an outer latch portion, and a pair of side latch portions extending therebetween and the limiter engagement surface extends along the inner latch portion and the side latch portions.

18. The step stool of claim 15, wherein latch includes a rim and limiter engagement surface is formed on the rim.

19. A step stool comprising a frame, a step mounted to the frame for pivotable movement relative thereto, the step including a platform and a pivot limiter plate, the platform being arranged to support a person thereon and including a periphery, the periphery including a notch member formed to include a notch, the pivot limiter plate being mounted to the notch member, and a latch mounted for pivotable movement relative to the step in the notch between a latch position to latch to the frame to block pivotable movement of the step relative to the frame and a release position to allow pivotable movement of the step relative to the frame, the latch including a limiter engager, the pivot limiter plate being positioned underneath the limiter engager for engagement therewith when the latch assumes the release position to limit pivotable movement of the latch in the notch away from the latch position.

20. The step stool of claim 19, further comprising a latch pivoter mounted to the pivot limiter plate and arranged to pivot the latch to the latch position.

21. The step stool of claim 20, wherein the latch pivoter includes a spring extending between the pivot limiter plate and the latch and the step includes a wall extending upwardly from the pivot limiter plate underneath the latch to inhibit access to the spring.

22. The step stool of claim 19, wherein the limiter engager includes a limiter engagement surface, the pivot limiter includes a latch engagement surface, and the limiter engagement surface is inclined relative to the latch engagement surface when the latch is positioned in the latch position and mates against the latch engagement surface when the latch is positioned in the release position.

23. The step stool of claim 19, wherein the notch member includes an inner wall and a pair of spaced-apart side walls extending outwardly from the inner wall and the pivot limiter plate is mounted to a bottom edge of each of the inner wall and the side walls so as to extend across the notch.

* * * * *